US007252022B1

(12) United States Patent
Losee

(10) Patent No.: US 7,252,022 B1
(45) Date of Patent: Aug. 7, 2007

(54) MULTIPLE SHOP SOCKET TOOL

(76) Inventor: Jerry L. Losee, P.O. Box 565, Lava Hot Springs, ID (US) 83246

( * ) Notice: Subject to any disclaimer, the term of this patent is extended or adjusted under 35 U.S.C. 154(b) by 0 days.

(21) Appl. No.: 09/223,870

(22) Filed: Dec. 31, 1998

Related U.S. Application Data

(63) Continuation-in-part of application No. 08/917,894, filed on Aug. 27, 1997, now abandoned.

(51) Int. Cl.
*B25B 13/06* (2006.01)

(52) U.S. Cl. ..... 81/124.5; 81/125.1

(58) Field of Classification Search ..... 81/439, 81/124.4, 124.5, 124.6, 125.1
See application file for complete search history.

(56) References Cited

U.S. PATENT DOCUMENTS 1,471,451 A * 10/1923 Crimp ..... 81/124.5
2,453,901 A * 11/1948 Gonsett et al. ..... 81/125.1
5,048,379 A * 9/1991 Gramera et al. ..... 81/124.4
5,157,995 A * 10/1992 Nogues ..... 81/124.6
5,163,344 A * 11/1992 Mathers ..... 81/124.5

* cited by examiner

*Primary Examiner*—Debra S Meislin
(74) *Attorney, Agent, or Firm*—Thompson E. Fehr; Fehr Law Firm

(57) ABSTRACT

A multiple socket tool combines two, three, or four socket sizes. The sockets are nested inside each other so the tool can be applied to different sizes of bolts or nuts for tightening and loosening such nuts and bolts without changing sockets. Compression springs and pins allow the inner sockets to depress into the larger socket allowing a user automatically to use the proper size. The tool is be driven by a ratchet wrench or an impact gun by connecting to an aperture within the tool. The multi sockets will consist of numerous standard and metric sizes.

3 Claims, 2 Drawing Sheets

MULTIPLE SHOP SOCKET TOOL

CROSS-REFERENCE TO RELATED APPLICATION

This is a continuation-in-part of U.S. application Ser. No. 08/917,894, filed Aug. 27, 1997, which will be abandoned.

STATEMENT REGARDING FEDERALLY SPONSORED RESEARCH OR DEVELOPMENT

Not applicable

TECHNICAL FIELD

This invention relates in general to impact and ratchet type socket tools.

BACKGROUND OF THE INVENTION

Socket tools of today take up a large amount of space in which a person is constantly searching through their tool box for the certain size socket to properly handle a job. Sockets of today come in numerous amounts of different standard and metric sizes which makes working on projects that have to be done quickly more difficult to accomplish in a short amount of time.

SUMMARY OF THE INVENTION

This invention is directed to ratchet and impact socket tools which are used to tighten and loosen nuts, bolts and lug nuts. The newly invented sockets are built with two to three sizes in one end that will eliminate a lot of frustrations of searching for the socket size in need. It also makes a great space-saving, easy-to-carry socket set. With this socket you can easily tighten or loosen three or more different sizes of bolts or nuts without the costly time of searching and changing sockets for every size.

The invention is a socket wrench consisting of different hexagon-shaped tools fitted or nested in such a way so they can move inside of one another being biased by springs and retained rivets. Each hexagon tool is pressured by its own individual compression spring. The hexagon tool has small rivet holes and slots that allows movement back and forth with the help of rivets restricting movement too far one way or the other and keeping the multiple socket tool in complete working form.

DETAILED DESCRIPTION OF THE INVENTION

Figure 1:
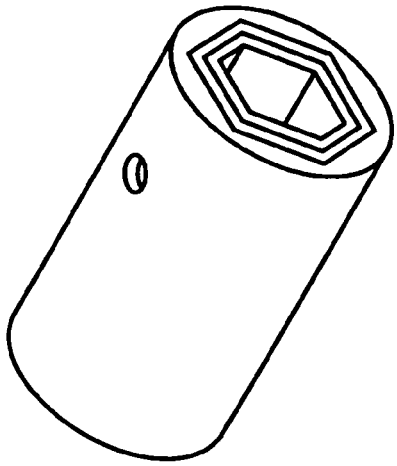
FIG. 1 is a perspective view of a three-sized multiple socket tool.
Figure 2:
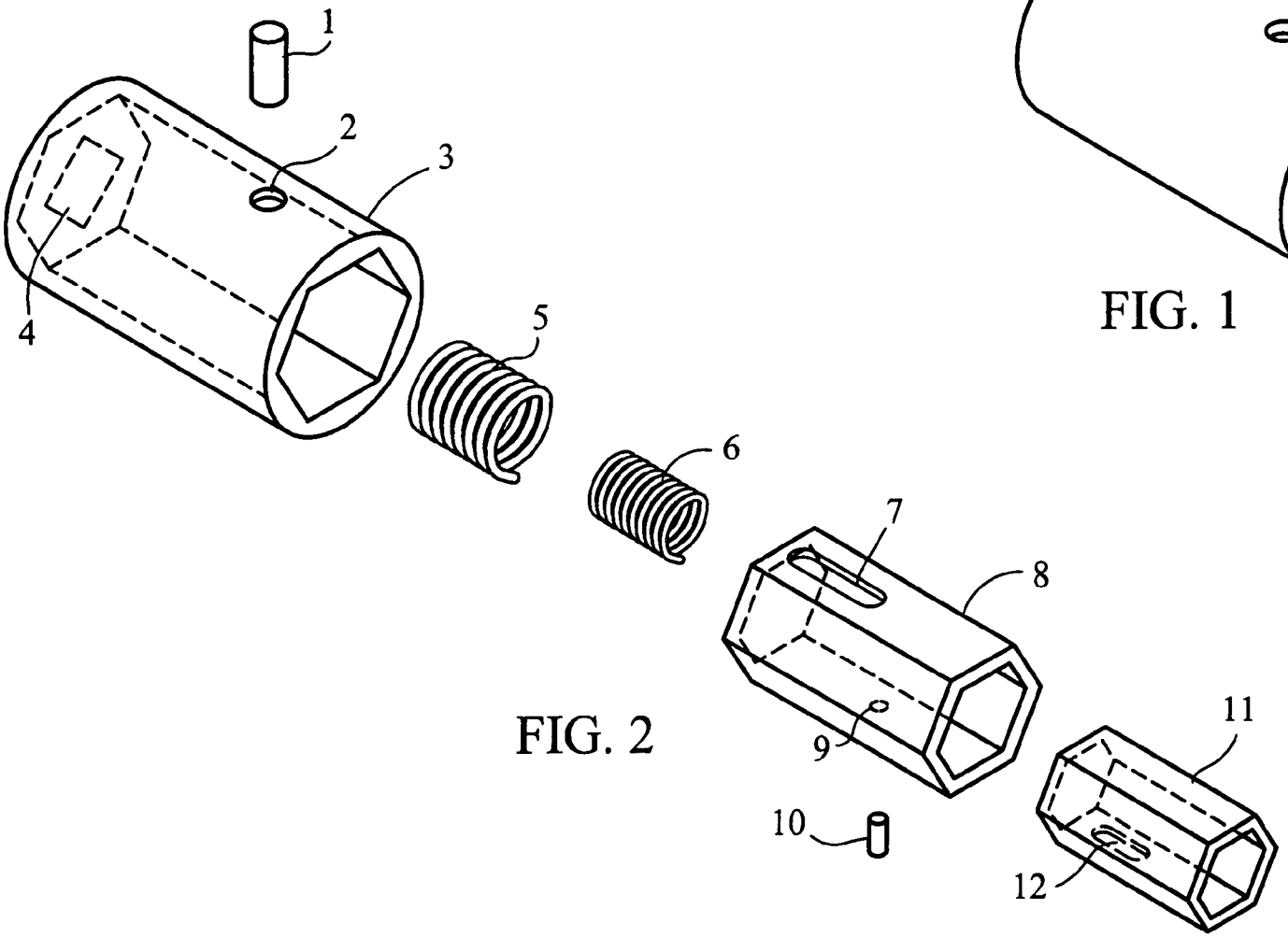
FIG. 2 is an exploded view of the three-sized multiple socket tool.

A perspective view of a large three-sized multi socket is illustrated in FIG. 1. Referring to FIG. 2, small rivet 1 fits tightly into hole 2 which also extends down through slot 7 that allows the middle hexagon tool 8 to slide back and forth inside of the outer socket 3. The large compression spring 5 is fitted behind the outer hexagon tool 8 that is nested inside socket 3 that keeps pressure applies to the outer hexagon tool 8. Small compression spring 6 is smaller than spring 5 but its purpose is the same except that it pushes on the inner hexagon tool 11. Rivet 10 fits tightly into hole 9, which extends into slot 12 and allows the outer hexagon tool 11 to move back and forth inside of middle hexagon tool 8. The square drive aperture 4 is for the application of an air gun or ratchet wrench device.

Figure 3:
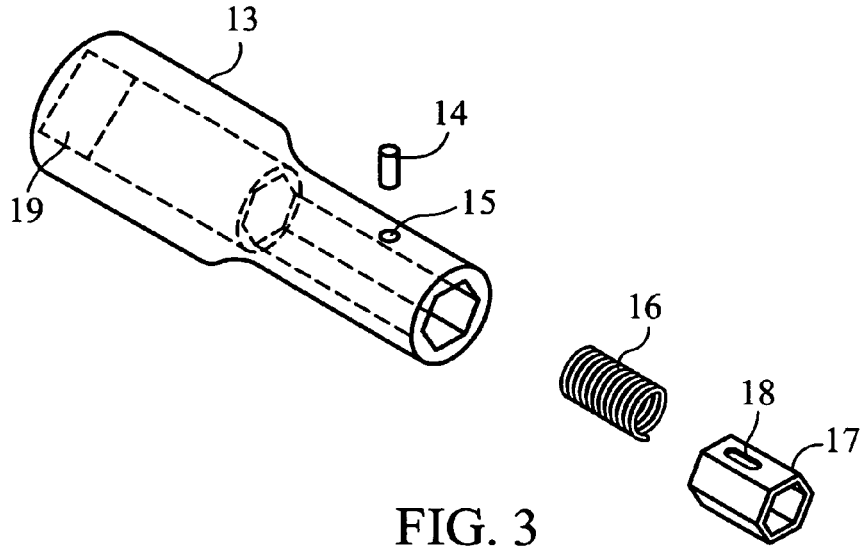
FIG. 3 is an exploded view of a smaller two-sized multiple socket tool.

FIG. 3 is a smaller two-sized multiple socket tool with only one compression spring 16 and one hexagon tool.

FIG. 3 illustrates a hardened metal multiple socket tool 13 which is used for tightening or loosening various sizes of nuts and bolts. The multiple sockets can be attached on an impact gun, ratchet wrench or any other socket attachment tool by inserting the attachment into aperture 19. As described above, rivet 14 fits in aperture 15 and engages slot 18.

Figure 4:
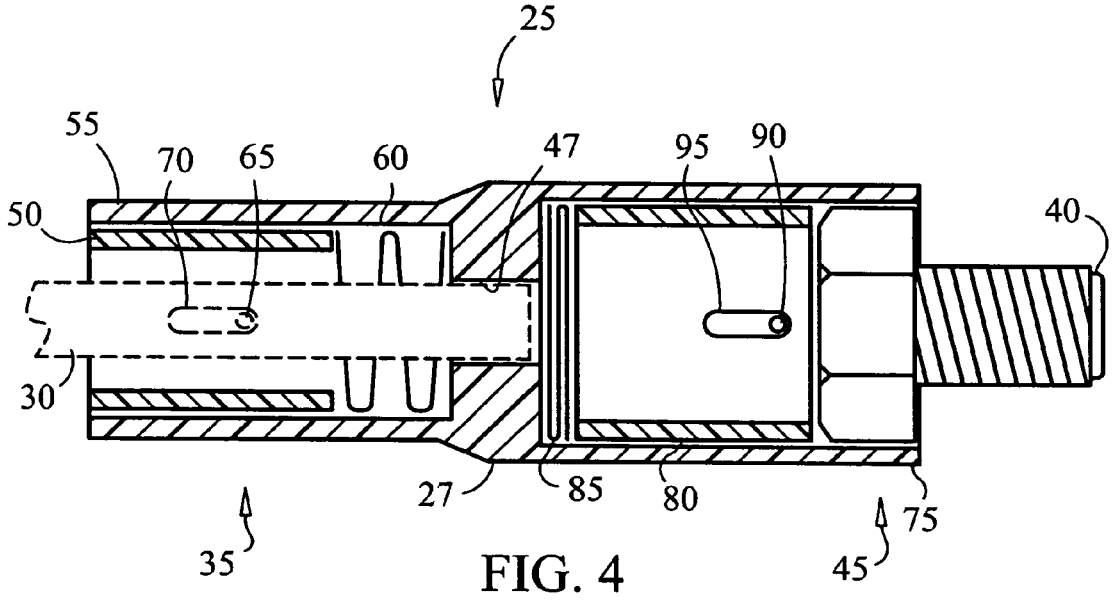
FIG. 4 is a side section view of a multiple socket tool having four socket sizes.

FIG. 4 illustrates a multiple socket tool 25 having four sockets within body 27 that, for example, could range from ⅞ inches up to 15⁄16 inches in 1⁄16 inch increments. This section view shows the square-sectioned driving tool 30 (in phantom) inserted within a first end 35 of tool 25 and a driven bolt 40 within a second end 45. The tool 30 inserts with square aperture 47. The first end smaller socket 50 is contained within the first end larger socket 55. Small spring 60 biases smaller socket to the left end extended position and is restrained by first end (pin) rivet 65 in the first end slot 70.

The second end 45 of tool 25 illustrates engagement of second end larger socket 75 with the bolt 40. The second smaller socket 80 is in a retracted position against large spring 85. When the tool 25 is removed from the bolt 40, large spring 85 restores the socket 80 to the right and is retained by second end (pin) rivet 90 in second end slot 95. It can be seen that the bolt and the driving tool can be reversed to accommodate four different size bolts.

What is claimed is:

1. A multiple socket tool comprising:

a body having a first end and a second end, the first end and second end having a hex-shaped interior, and a first and second end pin within the interior;

a first end smaller diameter hex-shaped socket within the first end, and the socket having a first end slot;

a spring biasing the smaller diameter hex-shaped socket to an extended position wherein the first end pin engages the first end slot;

a square aperture in a center section of the body;

a second end smaller diameter hex-shaped socket within the second end and the socket having a second end slot; and a large spring biasing the second end smaller diameter hex-shaped socket to an extended position wherein the second end pin engages the second end slot.

2. The tool of claim 1 wherein the sockets are sized for standard inch sizes.

3. The tool of claim 1 wherein the sockets are sized for standard metric sizes.

* * * * *